US009335112B1

(12) United States Patent
Sholley

(10) Patent No.: US 9,335,112 B1
(45) Date of Patent: May 10, 2016

(54) TELESCOPING GUN REST APPARATUS

(71) Applicant: Lynn A Sholley, Mifflinburg, PA (US)

(72) Inventor: Lynn A Sholley, Mifflinburg, PA (US)

( * ) Notice: Subject to any disclaimer, the term of this patent is extended or adjusted under 35 U.S.C. 154(b) by 0 days.

(21) Appl. No.: 14/628,279

(22) Filed: Feb. 22, 2015

(51) Int. Cl.
*F41A 35/00* (2006.01)
*F41A 23/18* (2006.01)

(52) U.S. Cl.
CPC ..... *F41A 23/18* (2013.01)

(58) Field of Classification Search
USPC ..... 42/94; 73/167; 43/19, 21.2; 224/922, 224/101, 149, 150, 191, 660, 662–664
See application file for complete search history.

(56) References Cited

U.S. PATENT DOCUMENTS 74,119 A * 2/1868 Muller ..... F41C 23/02 42/36
817,207 A * 4/1906 Wheeler ..... F41C 33/001 224/185
889,658 A * 6/1908 Burnaugh ..... F41C 33/001 42/94
1,406,827 A * 2/1922 Dumas ..... F41C 33/001 42/94
1,497,794 A * 6/1924 Saunders ..... F41C 23/04 42/148
2,552,205 A * 5/1951 Moss ..... F16M 13/04 224/259
2,711,122 A * 6/1955 Klumpp ..... F16M 13/04 224/185
2,771,826 A * 11/1956 Shapiro ..... F16M 13/04 224/257
3,191,826 A * 6/1965 Adams ..... F41C 23/12 224/185
3,200,528 A * 8/1965 Christensen ..... F41C 23/12 224/185
3,390,477 A * 7/1968 Galbraith ..... F41C 33/001 248/118
3,661,308 A * 5/1972 Walters ..... F16M 13/04 224/258
3,767,095 A * 10/1973 Jones ..... F16M 13/04 224/261
4,083,480 A * 4/1978 Lee ..... F16M 13/04 224/185
4,327,986 A * 5/1982 Carter ..... F16M 13/04 396/423
4,637,536 A * 1/1987 Wong ..... A45F 5/00 224/261
4,844,390 A * 7/1989 Duke ..... F41C 33/001 224/232
4,858,359 A * 8/1989 Danz ..... F41A 23/02 42/94
4,890,406 A * 1/1990 French ..... F41C 9/085 42/90
4,991,758 A * 2/1991 Eaneff ..... F16M 13/04 224/200
5,194,678 A * 3/1993 Kramer ..... F16M 11/16 42/94

(Continued)

*Primary Examiner* — Michael David
(74) *Attorney, Agent, or Firm* — Sonya C. Harris; Invention Services

(57) ABSTRACT

A telescoping gun rest apparatus having a belly plate serving as a base attachable to the belt of a wearer. The telescoping gun rest apparatus is a stabilizing shooting rest that includes an adjustable telescoping tube assembly which provides varying extensions, and is coupled to a ball and socket assembly providing at least two rotational degrees of freedom. The stabilizing shooting rest further includes a yoke serving as a rest at the distal end of the telescopic tube assembly, the yoke is substantially U-shaped and configured to stabilize a desired portion of a rifle, gun, or crossbow while the wearer and user of the telescoping gun rest apparatus is shooting.

8 Claims, 6 Drawing Sheets

(56) References Cited

U.S. PATENT DOCUMENTS 5,241,771 A * 9/1993 Caustic ..... F41C 33/001 42/94
5,351,867 A * 10/1994 Vest ..... F16M 13/04 124/89
5,528,846 A * 6/1996 Baggett ..... F16M 13/04 224/913
5,784,820 A * 7/1998 Wood ..... F41C 33/001 42/94
5,905,225 A * 5/1999 Joynt ..... B63B 3/10 89/36.02
5,930,931 A * 8/1999 Watson ..... F41A 23/04 206/317
5,988,466 A * 11/1999 Brown ..... F41C 33/001 224/185
6,082,034 A * 7/2000 Musmanno ..... F41B 5/1461 42/94
6,267,335 B1 * 7/2001 Barrett ..... F41C 33/001 248/118
6,764,231 B1 * 7/2004 Shubert ..... F16M 13/04 396/419
7,784,212 B1 * 8/2010 Chilton ..... F41A 23/16 42/94
8,096,223 B1 * 1/2012 Andrews ..... F41H 5/0492 89/36.02
8,215,045 B2 * 7/2012 Mitchell ..... F41C 23/20 42/71.01
8,365,649 B1 * 2/2013 Andrews ..... F41H 7/042 428/911
8,418,900 B1 * 4/2013 Baker ..... A45F 5/00 224/262
8,763,297 B2 * 7/2014 Boll ..... A01M 31/02 42/94
8,910,410 B2 * 12/2014 Peters ..... F41C 33/006 224/197
2013/0204496 A1 * 8/2013 Sloman ..... F41B 9/0087 701/45
2014/0090846 A1 * 4/2014 Deutch ..... E21B 29/00 166/297
2014/0109757 A1 * 4/2014 Akavuti ..... F41H 7/042 89/36.02

* cited by examiner

TELESCOPING GUN REST APPARATUS

FIELD OF INVENTION

The subject matter disclosed herein relates generally to shooting stability. More particularly, the subject matter relates to a stabilizing shooting rest apparatus and method, for aiding a shooter that is aiming at a particular target, and discharging a firearm or crossbow with the intent of its projectile making contact with and accurately hitting that particular target.

BACKGROUND

A hunter encounters numerous problems in the pursuit of his game. One of these problems is the necessity of keeping a steady aim on the target until a clear shot is available. Oftentimes, the hunter must keep his aim on the target for a prolonged period of time. When a shooter is aiming a firearm or crossbow, they typically concentrate on centering and holding the firearm or crossbow sights on the target. The slightest wavering of the firearm or crossbow while it is being aimed and fired will have an adverse effect on the performance and outcome of the shot. Perfectly aligning the firearm or crossbow sight and maintaining this position is crucial to achieving the desired accuracy. The consequence of any movement during the aiming and firing procedure will result in a deficiency in the projectile's accuracy.

There have been several inventions designed to address and achieve better projectile accuracy. In every case of prior art, the attempts to resolve or at least minimize firearm or crossbow movement at the time of aiming and firing addresses the stabilizing or steadying of the front portion, that being the fore end, or barrel end of the firearm or crossbow stock. However, the prior art attempts to minimize the wavering and movement of a firearm or crossbow by either focusing exclusively on supporting and stabilizing the shooters arm while attempting to support and minimize the firearm or crossbow's instability, wavering and movement.

Thus, a stabilizing shooting rest that focuses on maintaining stability of the shooter's arm while also providing enhanced contact with the shooter's along with versatility in shooting in any direction would be well received in the art.

SUMMARY

In accordance with the present invention there is provided an improved telescoping gun rest apparatus. This disclosure relates to a telescoping gun rest apparatus having a belly plate serving as a base attachable to the belt of a wearer. The telescoping gun rest apparatus is a stabilizing shooting rest that includes an adjustable telescoping tube assembly which provides varying extensions, and is coupled to a ball and socket assembly providing at least two rotational degrees of freedom. The stabilizing shooting rest further includes a yoke serving as a rest at the distal end of the telescopic tube assembly, the yoke is substantially U-shaped and configured to stabilize a desired portion of a rifle, gun, or crossbow while the wearer and user of the telescoping gun rest apparatus is shooting.

In accordance with an aspect of the present disclosure, there is disclosed a telescoping gun rest apparatus providing a stable rest that provides the mobility and versatility ranging from tree stands to ground locations and stalk hunting.

In accordance with yet another aspect of the present disclosure, there is disclosed a telescoping gun rest apparatus facilitating versatile shooting in any direction allowing a hunter to shoot in any direction.

In accordance with yet another aspect of the present disclosure, there is disclosed a telescoping gun rest apparatus with increased stability and agility by being wearable about the body of a hunter.

In accordance with yet another aspect of the present disclosure, there is disclosed a telescoping gun rest apparatus that is portable and easily dissembled.

In accordance with yet another aspect of the present disclosure, there is disclosed a telescoping gun rest apparatus that is durable and efficient to manufacture, and placed upon the market at a reasonable cost.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

BRIEF DESCRIPTION OF THE DRAWINGS

Embodiments of the present disclosure are described herein with reference to the drawings, in which.

The novel features which are characteristic of the invention, as to organization and method of use, together with further objects and advantages thereof, will be better understood from the following disclosure considered in connection with the accompanying drawings in which one or more preferred embodiments of the invention are illustrated by way of example. It is to be expressly understood, however, that the drawings are for the purpose of illustration and description only and are not intended as a definition of the limits of the invention.

As used herein, the term "comprises" refers to a part or parts of a whole, but does not exclude other parts. That is, the term "comprises" is open language that requires the presence of the recited element or structure or its equivalent, but does not exclude the presence of other elements or structures. The term "comprises" has the same meaning and is interchangeable with the terms "includes" and "has". The term set has the meaning of one or more of said element. Furthermore, any use of the term "or" as used herein is generally intended to mean "and/or" unless otherwise indicated. Combinations of components or steps will also be considered as being noted, where terminology is foreseen as rendering the ability to separate or combine is unclear.

DETAILED DESCRIPTION

Figure 1:
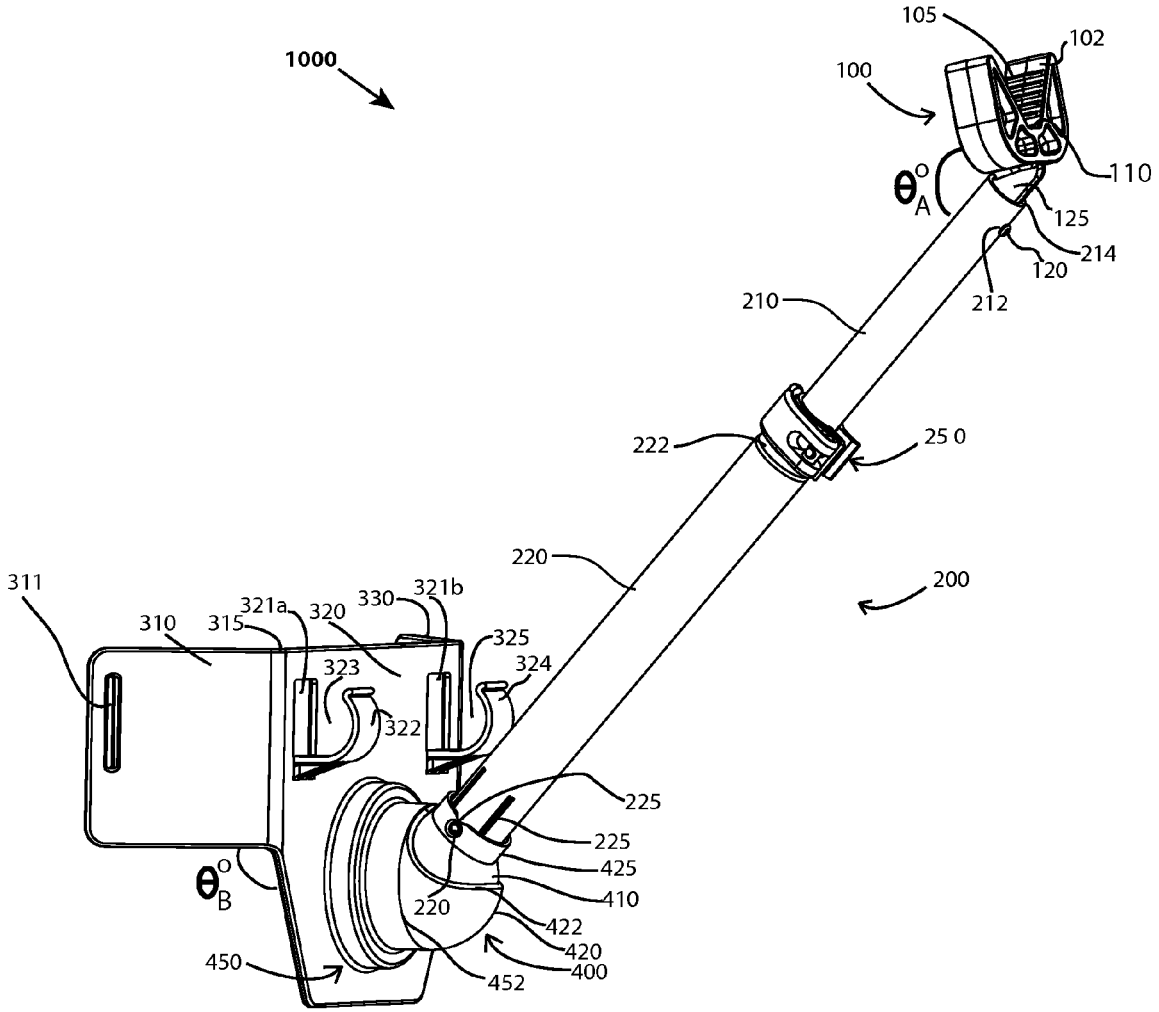
FIG. 1 is a drawing illustrating a front left side perspective diagram of the telescoping gun rest apparatus in accordance with an embodiment of the present invention.
Figure 2:
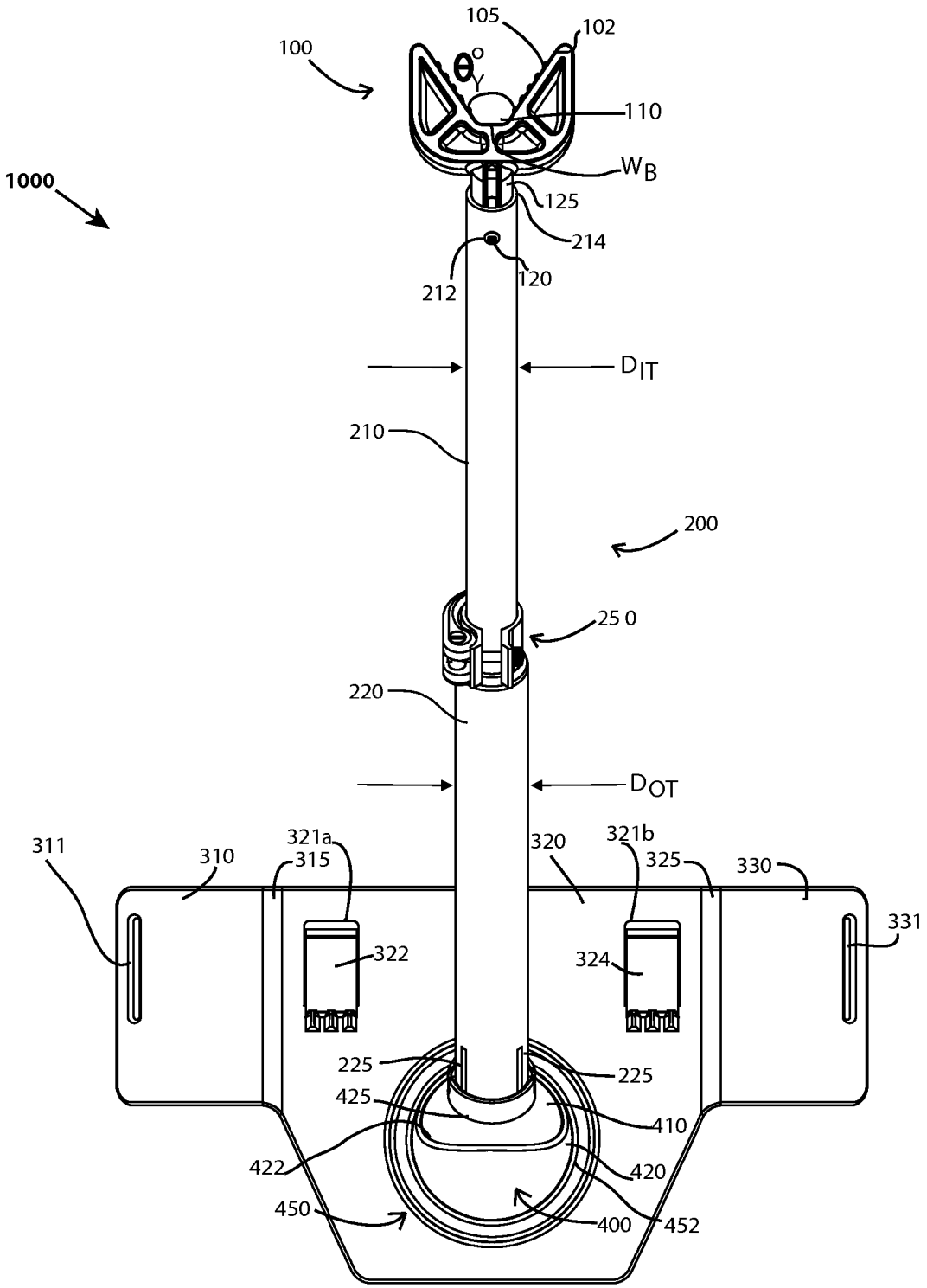
FIG. 2 is a drawing illustrating a front elevational diagram of the telescoping gun rest apparatus in accordance with an embodiment of the present invention.
Figure 3:
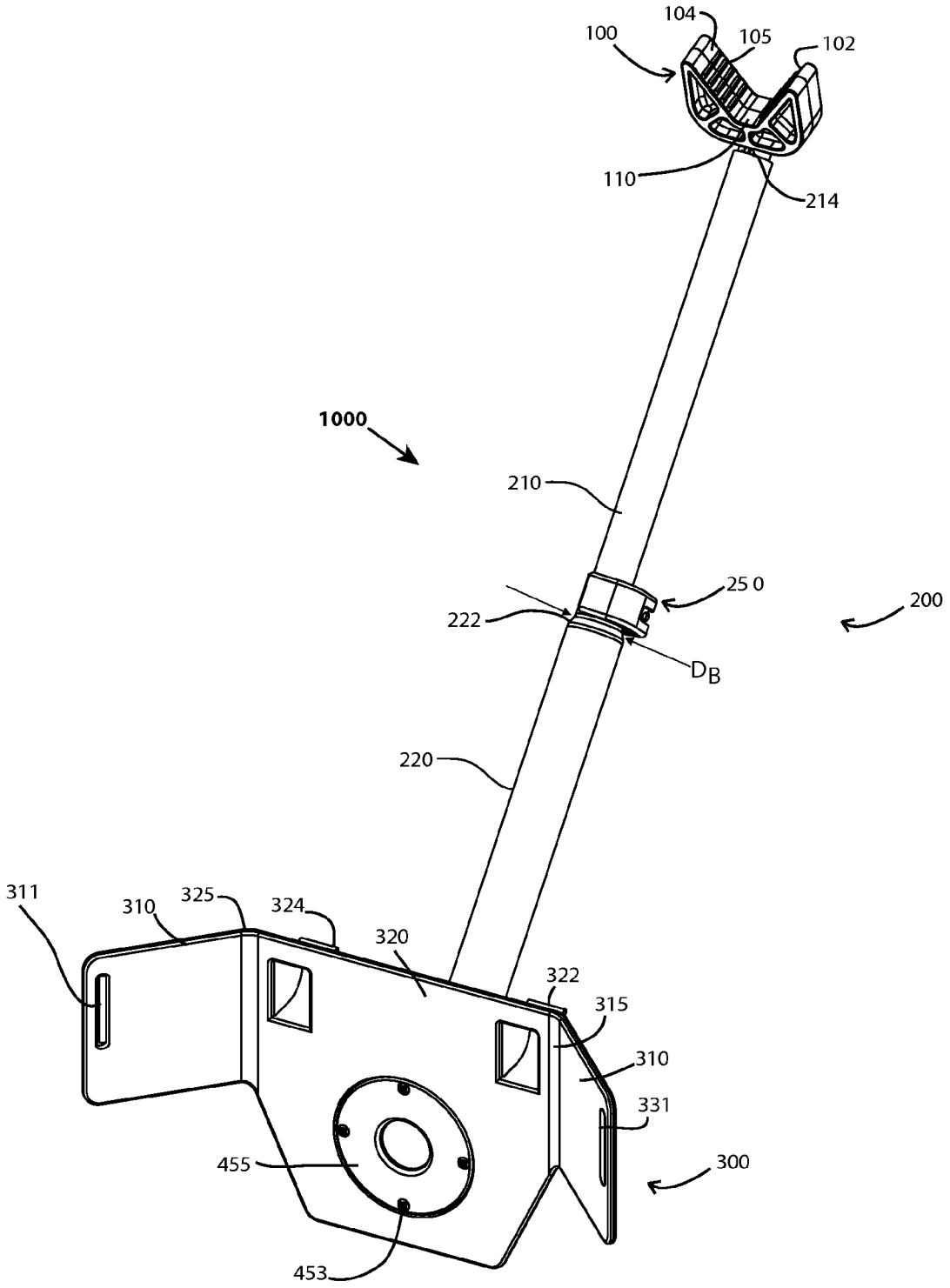
FIG. 3 a drawing illustrating a rear left side perspective diagram of the telescoping gun rest apparatus in accordance with an embodiment of the present invention.
Figure 4:
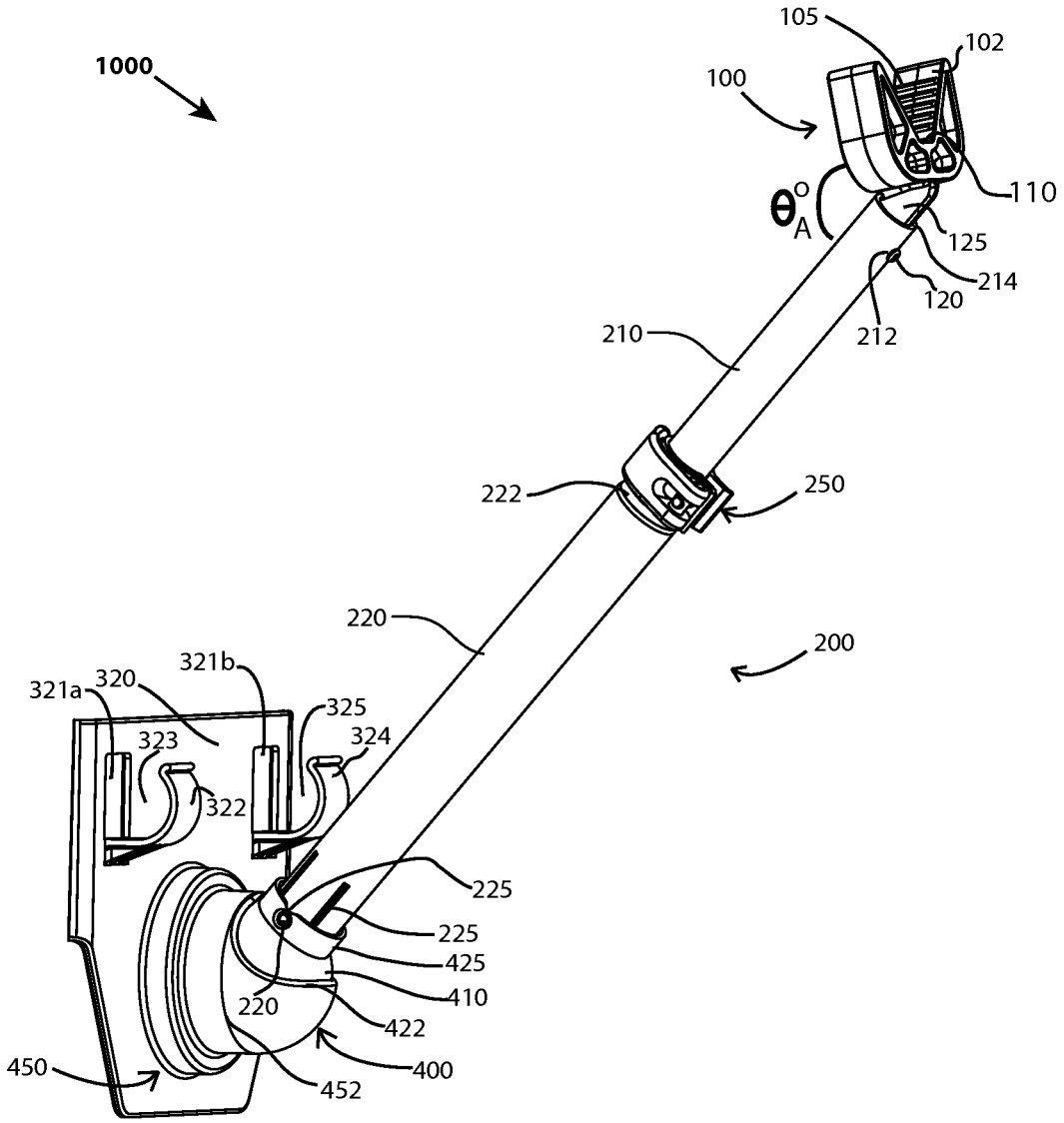
FIG. 4 is a drawing illustrating a front left side perspective diagram of the telescoping gun rest apparatus in accordance with another embodiment of the present invention.
Figure 5:
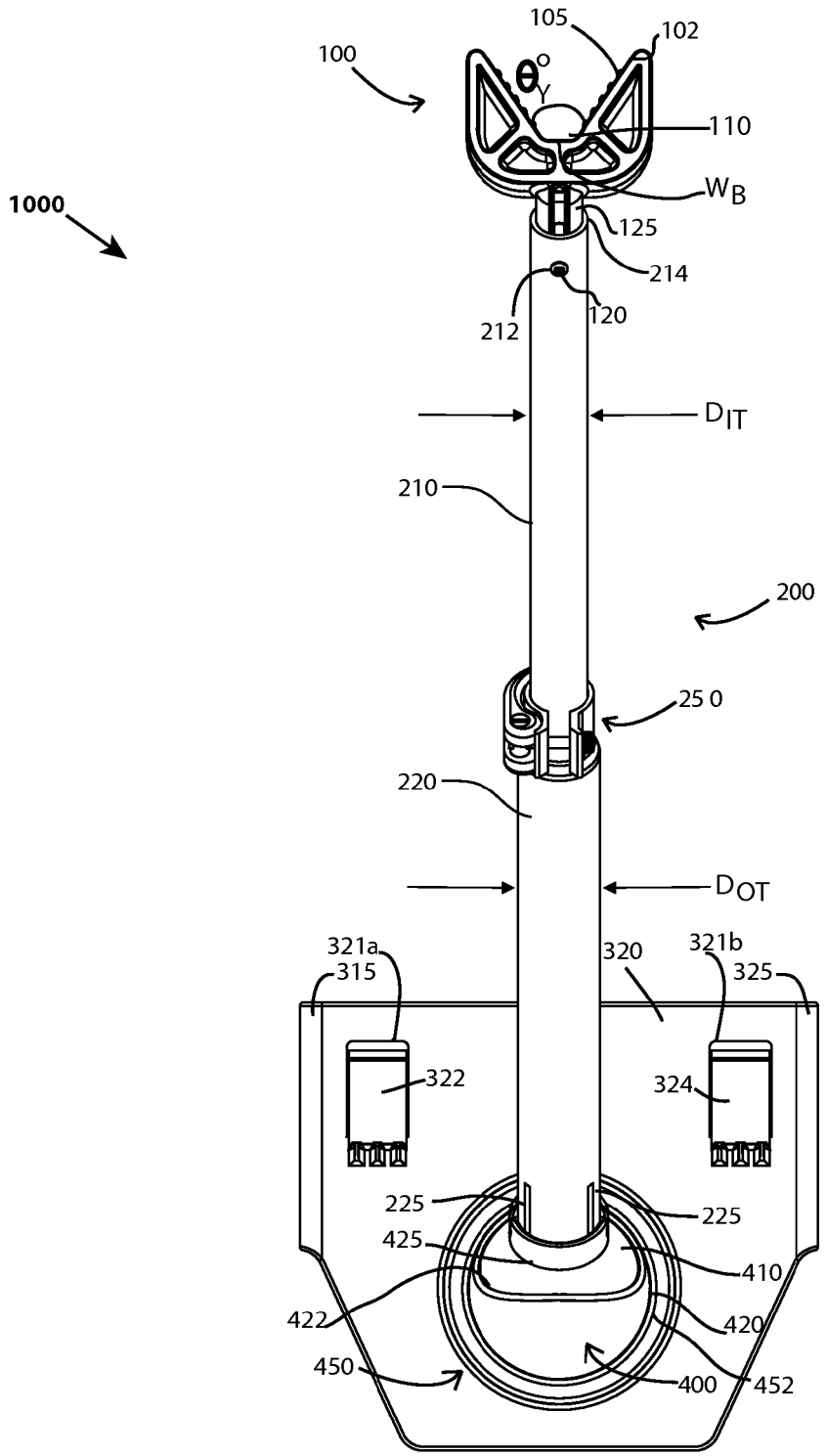
FIG. 5 is a drawing illustrating a front elevational diagram of the telescoping gun rest apparatus in accordance with another embodiment of the present invention.
Figure 6:
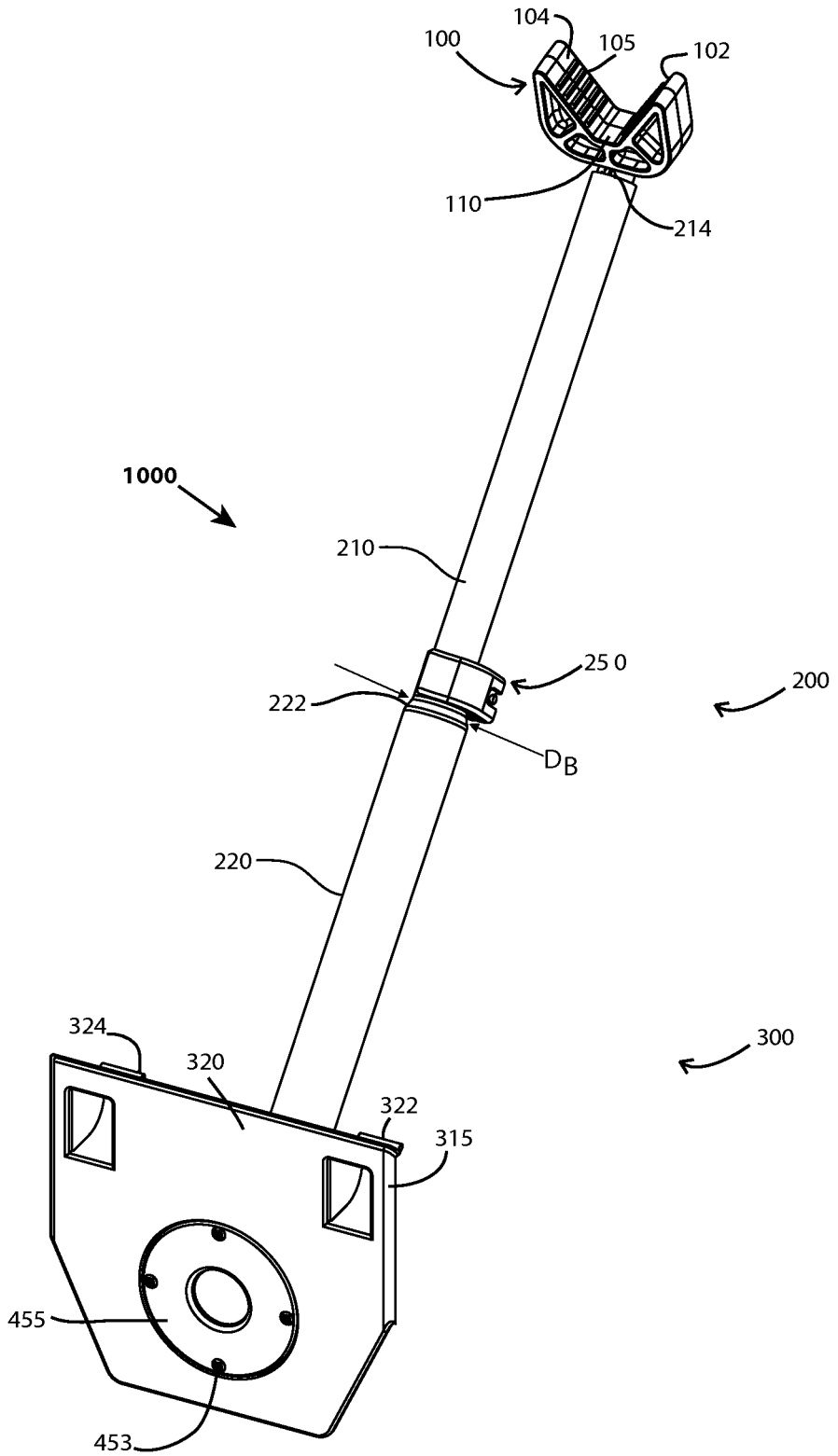
FIG. 6 a drawing illustrating a rear left side perspective diagram of the telescoping gun rest apparatus in accordance with another embodiment of the present invention.

Referring now to FIGS. 1-6, a Telescoping Gun Rest Apparatus (TGRA) 1000 is illustrated. The TGRA 1000 is a portable and readily dissembling apparatus used to holster and stabilize while steadying and aiming to shoot a gun or bow and arrow, or the like. The TGRA 1000 is comprised of four major components including the yoke 100, telescoping tube assembly 200, belly plate 300, and the ball and socket assembly 400. FIG. 1 is a front left side perspective diagrammatic drawing of the TGRA 1000, and FIGS. 2 and 3 are front and rear perspective drawings, respectively. FIGS. 1-3 illustrate a first embodiment with the belly plate 300 having multiple side panels 310 and 330, providing more surface area for contact with the wearer. FIGS. 4-6 illustrate another embodiment of the TGRA 100 wherein the belly plate 300 has a planar configuration without side panels forming a more streamlined design consideration. As can be gleaned in the Figures, the yoke 100 is substantially U-shaped and is adapted, dimensioned, and configured for removably attaching to the telescoping tube assembly 200 which is coupled to the ball and socket assembly 400, which is in turn connected to the belly plate 300.

As shown best in FIGS. 2 and 3, the belly plate 300 may be configured as a unitary structure comprised of three major planar panels 310, 320, and 330 contiguously connected to one another via connecting panels 315 and 325, respectively. Each of the two side panels 310 and 330 are offset and angled inward relative to the central panel 320 by an angle $Ø_B$ having a value of approximately 135 degrees by way of curved connecting panels 315 and 325. This angled offset of the side panels 310 and 330 allow for an inward curvature of the belly plate 300 such that said belly plate 300 can essentially fit about the front side of user of the TGRA 1000. The belly plate 300 has an overall dimension of approximately 14 inches long and about 8 inches tall, with the central panel being approximately 7.5 inches wide and each of the side panels 310 and 330 approximately 4 inches in width and height. In some embodiments, such as in FIGS. 4-6, the belly plate 300 may have larger dimensions to provide more surface area when resting upon the body of the user while preparing to aim and shoot.

The belly plate 300 can be formed of molded hard plastics, such as the common thermoplastic polymer acrylonitrile butadiene styrene (ABS) thereby being of a substantially rigid material having sufficient durometer strength to maintain shape and rigidity, hence stability, of said belly plate 300 when the TGRA 1000 is worn and/or in use. Both of the side panels 310 and 330 each have fastening means such as longitudinal slots 311 and 331 serving as apertures for receiving a fastener such as a belt or the like, for fastening about the wearer of the TGRA 1000. The longitudinal slots 311 and 331 may have a diameter of approximately a quarter inch, to thereby accommodate and hold a belt or strap which may be threaded through said slots 311 and 331 and fastened about the wearer of the TGRA 1000. Additionally, the set of apertures 321*a* and 321*b*, located opposite the fastening clips 322 and 324 may also serve as slots for receiving a fastener such as a belt or the like, for fastening about the wearer of the TGRA 1000, especially in embodiments such as FIGS. 4-6.

As seen in FIGS. 1 and 2, the central panel 320 has a set of tube holding means, clips 322 and 324, which extend laterally there from forming holding slots 323 and 325, which are sized, configured and adapted to hold the telescoping tube assembly 200, when the TGRA 1000 is being transported, or is not in use. Therefore, holding slots 323 and 325 may have a width in the range of approximately ¾ inch to 1½ inch to accommodate and frictionally hold the diameter of either the inner tube 210 or outer tube 220 interchangeably. In one embodiment the belly plate 300 has a substantially trapezoidal shape as the side panels 310 and 330 may be substantially rectilinear (or rounded rectilinear) and the central panel 320 being trapezoidal as the set of tube holding means (clips 322 and 324) are located on the upper proximal portion of the central panel 320, and the ball and socket assembly 400 is located on the lower distal portion of the belly plate 300. This structural location of the ball and socket assembly 400 at the lower, distal portion of the belly plate 300 facilitates counterbalancing of the TGRA 1000 when it's in use and a gun is resting in the yoke 100.

The telescoping tube assembly 200 may be comprised of at least two tubes, such as inner tube 210 and outer tube 220 coupled to one another in a telescoping fashion by a connecting means such as clamp 250. In a preferred embodiment, the inner tube 210 has a diameter $D_{IT}$ that is smaller than that of the outer tube 220 diameter $D_{OT}$ (see FIG. 2) to facilitate longitudinal telescoping movement between the inner tube 210 and outer tube 220. The outer tube 220 may have a first diameter along the major length of the tube and have a more tapered, beveled distal end 222 with a smaller diameter $D_B$ closest to a value of DIT to facilitate friction fitting between the beveled distal end 222 and the proximal end of inner tube 210 when the inner tube 210 is inserted within and connected to outer tube 220 by way of the clamp 250. Therefore, it follows that $D_{OT}>D_B>D_{IT}$.

In one embodiment, the inner tube 210 may have a diameter ranging from approximately 0.75 to 1.25 inches; and the outer tube 220 may have a diameter ranging from approximately 1.25 inches to 1.50 inches. However, more important than the individual tube diameters is the relative sizes to one another as the relative diameters of the outer and inner tubes should be within 4/10 of an inch of each other to allow telescoping, i.e., longitudinal movement of the inner tube 210 within the outer tube 220. This longitudinal, telescoping movement between the two tubes provides varying extension lengths of the telescoping tube assembly 200. In a preferred embodiment, the outer tube 220 has an approximate length of 13 inches, and the inner tube 210 has an approximate length of 14 inches. The telescoping tube assembly 200 having a telescoping extension having a range of approximately 16-28 inches. The inner tube 210 and outer tube 220 may both be formed of hard plastics, such as the common thermoplastic polymer acrylonitrile butadiene styrene (ABS).

As shown, the connecting means may comprise a clamp 250 for mechanically, frictionally, and releasably securing the beveled distal end 222 to the proximal end of inner tube 210. The clamp 250 can be any conventional tube/pipe clamping mechanism providing a secure, quick snap and release function for readily coupling and decoupling the inner and outer tubes (210 and 220). As such tube/pipe clamping mechanisms are well known, an artisan of ordinary skill in the art could readily substitute the shown locking bar clamp with any suitable equivalent without departing from the scope of the instant invention.

In a preferred embodiment, the proximal end of the outer tube 220 is configured to removably, matingly attach to the ball and socket assembly 400. The ball and socket assembly 400 is comprised of a ball 410 rotably set within a socket 420 housed by a hub sprocket 450. The ball has a ball collar 425 having one or more hub apertures 415 which are sized, dimensioned and configured to mate with slot 225 forged therein along with a protruding nub 227 sized and dimensioned to protrude and matingly fit within a nub aperture 415. In this embodiment, a dual slot 225 and nub 227 configuration on either side of the lower, proximal end of the outer tube 220.

The hub sprocket 450 may comprise a sprocket collar 452 for receiving, and connecting to the socket 420; and a sprocket base 451 affixed to the central panel 320 of the belly plate 300. As can be gleaned in a rear view shown in FIG. 3, the sprocket hub 450 comprises an anterior back plate 455 for securing the ball and socket assembly 400 to the belly plate 300 with a set of fasteners 453. The fasteners 453 may be any suitable screws, bolts or equivalent connectors known in the art for securing said belly plate 300 to said ball and socket assembly 400. To facilitate lateral, longitudinal and angular rotational movement of the ball 410 within the socket 420, the socket has a forged semicircular opening 422 (see FIG. 2) having an elliptical shape providing a range of motion of the ball 410 within the socket 420 in the range of approximately 100 degrees laterally and 15 degrees longitudinally.

As best seen in FIGS. 1 and 2, the upper, distal end of the inner tube 210 includes a coupling notch 212 for receiving and engaging with connecting nub 120 of yoke 100. The connecting nub 120 may be a forged protrusion, or any suitable bolt, screw, or equivalent fastening connector known in the art for securing said inner tube 210 to the yoke 100. The yoke 100 is the upper-most part of the TGRA 1000 and is the element that a barrel of a gun is held within when aiming and firing. The yoke 100 is substantially U-shaped thereby configured to receive, rest and hold a shotgun, rifle or crossbow therein, and further comprises a connecting shaft yoke arm 125, sized, dimensioned and configured for insertion within the upper, proximal end of inner tube 210. The yoke 100 may be formed of thermoplastic elastomers (TPE), also referred to as thermoplastic rubbers, and is easily manufactured with an injection molding process.

The substantially U shaped mouth of the yoke 100 is formed by two opposing walls 102 and 104 forming the inner sides of the yoke 100 and joined by a base 110. The base 110 has an approximate width $W_B$ of 3 inches and each of the adjoining sidewalls 102 and 104 having a rise of approximately 4 inches. The sidewalls 102 and 104 are sloped away from each other originating at the base and forming an interior angle within the yoke $Ø_Y$ of approximately 135 degrees, thus forming the substantial U-shape. The sidewalls 102 and 104 also each have an array of ridges 105 providing a gripping friction surface which assists in keeping the rifle, gun or crossbow stationary and resting upon the base 110. The yoke 100 sits at an angle $Ø_A$ that is approximately 125 degrees with respect to the tube assembly 200 (see FIG. 1).

It is to be appreciated that one or more of the elements depicted in the drawings/figures can also be implemented in a more separated or integrated manner, or even removed or rendered as inoperable in certain cases, as is useful in accordance with a particular application. Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth.

Therefore, many modifications may be made to adapt a particular situation or material to the essential scope and spirit of the present invention. It is intended that the invention not be limited to the particular terms used and/or to the particular embodiment disclosed as the best mode contemplated for carrying out this invention, but that the invention will include any and all embodiments and equivalents falling within the scope of the instant disclosure. For example, the components formed out of ABS hard plastics (such as the telescoping tube assembly 200 and belly plate 300), may be also formed from metals and/or composites thereof. Moreover, the yoke 100 may also be made of metals in lieu of rubber, and can have rubberized parts, such as, for example the ridges 105. Furthermore, in some embodiments, instead of having two telescoping tubes 210 or 220, a single tube having collapsible and extendible sections which telescope about one another may be employed in lieu of two tubes. Moreover, in other embodiments, more than two telescoping tubes may be used as well.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

What is claimed is:

1. A portable, collapsible, telescoping shooting rest assembly, comprising a substantially planar belly plate, said belly plate having a set of fastening means forged from and extending from the body of the belly plate, and said belly plate having a set of fastening apertures;

a telescoping tube assembly for providing longitudinal translational length adjustments;

a first inner tube having a first diameter and a second outer tube having a second diameter, wherein said first diameter is smaller than said second diameter;

a ball and socket assembly within the belly plate providing angular rotational motion of the telescoping tube assembly and being configured to allow the telescoping tube assembly to pivot about a plurality of axes relative to the belly plate;

a clamp for releasably coupling said first inner tube to said second outer tube;

a yoke for stabilizing the aim of a shooting device when using the telescoping shooting rest assembly, said yoke having a yoke arm and a yoke mouth formed by two opposing walls and configured for receiving a shooting device, wherein said yoke extends from the telescoping tube assembly at an obtuse angle, and wherein the set of fastening apertures are opposite said fastening means;

and wherein the ball and socket assembly further comprises a ball, a ball collar extending from said ball, a ball sleeve; and sprocket means for coupling said ball and socket assembly to the body of the belly plate; said sprocket means attached to and extending perpendicularly from said belly plate, and wherein said ball sleeve is contoured and configured for rotably containing said ball therein.

2. The portable, collapsible, telescoping shooting rest assembly of claim 1, wherein said sprocket means comprises a sprocket collar for at least partially encircling said ball, and connected to a sprocket hub for coupling to the belly plate.

3. The portable, collapsible, telescoping shooting rest assembly of claim 2, wherein said yoke mouth has a substantially U shape configuration.

4. The portable, collapsible, telescoping shooting rest assembly of claim 3, wherein said fastening means of said belly plate comprise a set of clip fasteners forged from and extending from the body of the belly plate, said clip fasteners sized, shaped and dimensioned to releasably receive and hold the telescoping tube when dissembled.

5. The portable, collapsible, telescoping shooting rest assembly of claim 4, wherein said outer tube has a beveled proximal end, and wherein the distal end of said outer tube comprises a first connecting means for releasably connecting the distal end of said outer tube with the ball collar.

6. The portable, collapsible, telescoping shooting rest assembly of claim 5, wherein said ball collar has a second connecting means for realeasbly coupling to the first connecting means of the outer tube.

7. The portable, collapsible, telescoping shooting rest assembly of claim 6, wherein said clamp has a set of releasable fasteners, and said clamp is sized, dimensioned and configured to clamp about the proximal end of the outer tube and the distal end of the inner tube.

8. The portable, collapsible, telescoping shooting rest assembly of claim 7, wherein said ball sleeve is contoured and configured with an angular opening allowing angular rotational movement of said ball.

* * * * *